US009612046B2

(12) United States Patent
Marciniak et al.

(10) Patent No.: US 9,612,046 B2
(45) Date of Patent: Apr. 4, 2017

(54) SUB-COOLED CONDENSER HAVING A RECEIVER TANK WITH A REFRIGERANT DIVERTER FOR IMPROVED FILLING EFFICIENCY

(71) Applicant: MAHLE International GmbH, Stuttgart (DE)

(72) Inventors: Mariusz Marciniak, Ostrow Wielkopolski (PL); Piotr Swisulski, Ostrow Wielkopolski (PL); Scott E. Kent, Albion, NY (US)

(73) Assignee: MAHLE International GmbH, Stuttgart (DE)

( * ) Notice: Subject to any disclaimer, the term of this patent is extended or adjusted under 35 U.S.C. 154(b) by 228 days.

(21) Appl. No.: 13/714,834

(22) Filed: Dec. 14, 2012

(65) Prior Publication Data

US 2014/0166256 A1 Jun. 19, 2014

(51) Int. Cl.
*F25B 39/04* (2006.01)
*F25B 40/02* (2006.01)

(52) U.S. Cl.
CPC ..... *F25B 39/04* (2013.01); *F25B 40/02* (2013.01); *F25B 2339/0441* (2013.01)

(58) Field of Classification Search
CPC .. F25B 39/04; F25B 40/02; F25B 2339/0441; F25B 2339/044; F25B 2339/0442
USPC ..... 165/132, 174; 62/509
See application file for complete search history.

(56) References Cited

U.S. PATENT DOCUMENTS

| | | | | |
|---|---|---|---|---|
| 5,666,791 | A * | 9/1997 | Burk | F25B 39/04 62/474 |
| 6,397,627 | B1 | 6/2002 | Aki | |
| 6,430,945 | B1 * | 8/2002 | Haussmann | 62/509 |
| 6,494,059 | B2 * | 12/2002 | Yamazaki et al. | 62/509 |
| 7,093,461 | B2 * | 8/2006 | Patel et al. | 62/509 |
| 7,213,412 | B2 | 5/2007 | Kent et al. | |
| 2005/0279125 | A1 * | 12/2005 | Operschall | 62/509 |
| 2006/0185385 | A1 * | 8/2006 | Feldhaus | F25B 39/04 62/509 |

(Continued)

OTHER PUBLICATIONS

Development of Sub-Cool System; Y. Yamanska, H. Matsuo, Kaoru Tuzuki, Toshio Tsuboko; pp. 37-42.

*Primary Examiner* — Len Tran
*Assistant Examiner* — Hans Weiland
(74) *Attorney, Agent, or Firm* — Brinks Gilson & Lione

(57) ABSTRACT

A sub-cooled condenser for an air conditioning system, having a condenser portion, a sub-cooler portion located below that of the condenser portion, an adjacent receiver tank having a first fluid port in hydraulic connection with the condenser portion and a second fluid port in hydraulic connection with the sub-cooler portion, and a refrigerant diverter assembly disposed in the receiver tank. The refrigerant diverter assembly is configured to divert a refrigerant from the first fluid port to a location beneath the surface level of a refrigerant retained within the receiver tank without impacting the surface level. The refrigerant diverter assembly includes a refrigerant port in hydraulic connection with the first fluid port, axial and annular refrigerant passageways, and a refrigerant conduit having an inlet end in hydraulic communication with the annular passageway and a second fluid port beneath the surface level (S) of the liquid phase refrigerant.

16 Claims, 4 Drawing Sheets

(56) References Cited

U.S. PATENT DOCUMENTS

2010/0147019 A1* 6/2010 Kaspar ..... F25B 39/04
62/509

* cited by examiner

SUB-COOLED CONDENSER HAVING A RECEIVER TANK WITH A REFRIGERANT DIVERTER FOR IMPROVED FILLING EFFICIENCY

TECHNICAL FIELD OF INVENTION

The present disclosure relates to an air conditioning system; specifically, to a condenser for an air-conditioning system; and more specifically, to a sub-cooled condenser having a receiver/dehydrator tank.

BACKGROUND OF INVENTION

Heat exchangers used to condense a high pressure vapor refrigerant into a high pressure liquid refrigerant for an air-conditioning system are known in the art and are referred to as condensers. Condensers having an integral sub-cooler portion are known as sub-cooled condensers, which typically include a plurality of refrigerant tubes in hydraulic communication with two spaced apart headers, such as an inlet/outlet header and a return header. The tubes are divided into an upstream group and a downstream group, the latter of which is also known as the "sub-cooling" group. For condensers having an inlet/outlet header and a return header, the headers typically include an internal partition that divides each of the headers into a first chamber and a second chamber. The first chambers are in hydraulic communication with the upstream group of tubes to define a condenser portion and the second chambers are in hydraulic communication with the sub-cooling group of tubes to define a sub-cooler portion.

A high pressure vapor refrigerant enters the first chamber of the inlet/outlet header and flows through the upstream group of tubes into the first chamber of the return header. As the refrigerant flows through this condenser portion, the refrigerant is condensed, or liquefied, into a high pressure liquid refrigerant at or near its saturation temperature. The liquefied refrigerant is then directed through a receiver tank. The receiver tank may include a desiccant material to remove any water before the liquefied refrigerant enters the second chamber of the return header to be directed through the sub-cooling group of tubes. As the refrigerant flows through this sub-cooler portion, the high temperature liquid refrigerant is sub-cooled below its saturation temperature. It is known that sub-cooled refrigerant improves the overall cooling performance of an air-conditioning system.

There exists a need to provide a stable liquefied refrigerant to the sub-cooler portion of the condenser for improved sub-cooling of the refrigerant. There also exists a need to maintain a sufficient amount of refrigerant reserve in the receiver tank to account for refrigerant leakage over the operating life of the air-conditioning system while minimizing the amount of refrigerant charge in the air-conditioning system without compromising the efficiency of the air-conditioning system. There is also a further need to minimize the size and complexity of the sub-cooled condenser for ease of plumbing and assembly into a motor vehicle.

SUMMARY OF THE INVENTION

In accordance with an embodiment of the invention is sub-cooled condenser having a refrigerant diverter assembly for use in an air conditioning system. The sub-cooled condenser includes a condenser portion located above a sub-cooler portion, with respect to the direction of gravity, and a receiver tank. The receiver tank includes a first fluid port in hydraulic connection with the condenser portion for receiving a condensed substantially liquid refrigerant at or near saturation and a second fluid port in hydraulic connection with the sub-cooler portion for discharging the liquid phase refrigerant. The receiver tank also includes an elongated housing extending along a receiver axis adjacent to a second header of the sub-cooled condenser, an open end, and an interior surface defining an interior cavity for retaining a predetermined amount of liquid phase refrigerant having a surface level (S) at or above the second fluid port. A refrigerant diverter assembly is disposed in the receiver cavity through the open end, which is then sealed with an end cap. The refrigerant diverter assembly is configured to divert the liquid phase refrigerant from the first fluid port of the receiver housing to a location within the receiver cavity beneath the surface level (S) of the liquid phase refrigerant adjacent to the second fluid port of the receiver tank.

The diverter assembly includes a perimeter diverter wall having an exterior surface and an opposite interior surface, a refrigerant port in hydraulic communication with the exterior and interior surfaces, and annular sealing means disposed on either side of the fluid port on the exterior surface. The refrigerant diverter assembly is configured to be insertable through the open end of the receiver housing with the annular sealing means abutting the interior surface of the receiver housing and positioned into the receiver cavity such that the exterior surface of the perimeter diverted wall is oriented toward and spaced from the interior surface of the receiver housing, thereby defining an annular refrigerant passageway therebetween the surfaces and the sealing means. The interior surface of the perimeter diverter wall defines an axial refrigerant passageway through the refrigerant diverter assembly to accommodate for the fluctuation of the surface level (S) of the liquid phase refrigerant due to changes in demand of the air conditioning system.

The refrigerant port of the refrigerant diverter assembly is in hydraulic communication with the first fluid port, such that condensed refrigerant flows from condenser portion through the first fluid port of the receiver tank into the annular passageway and then exits through the refrigerant port of the refrigerant diverted assembly. The refrigerant diverter assembly further includes a refrigerant conduit having an inlet end in direct hydraulic communication with the annular refrigerant passageway through the refrigerant port. The refrigerant conduit includes an outlet end immediately adjacent to or beneath the second fluid port with respect to the direction of gravity.

An advantage of the embodiment of the sub-cooled condenser having a refrigerant diverter assembly ensures a stable liquefied refrigerant to the sub-cooler portion of the sub-cooled condenser regardless if the condenser portion is an up-flow condenser or a down-flow condenser. Another advantage is that the sub-cooled condenser absorbs the fluctuations in the required refrigerant amount inside the refrigerant cycle caused through changes in load demands. Yet another advantage is that the sub-cooled condenser maintains constant performance and quality against leakage of refrigerant from hoses and fittings. Still yet another advantage is that the sub-cooled condenser is compact and simple to plumb within a confined compartment of a motor vehicle.

Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Referring now to the FIGS. 1 through 5, wherein like numerals indicates like or corresponding parts throughout the several views.

Figure 1:
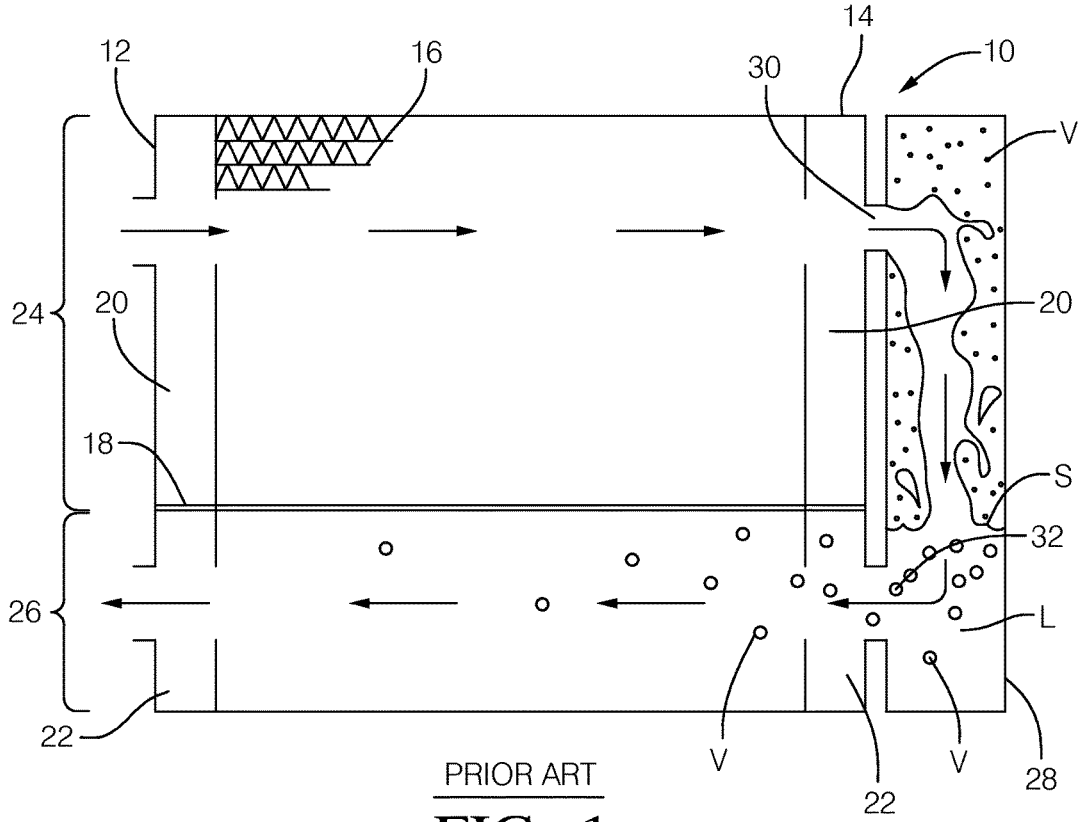
PRIOR ART FIG. 1
FIG. 1 shows a schematic front view of a prior art sub-cooled condenser having an integral receiver tank.

Shown in FIG. 1 is a schematic front view of a prior art sub-cooled condenser 10 having an inlet/outlet header 12, a return header 14 spaced from the inlet/outlet header 12, and a plurality of refrigerant tubes 16 extending between and in hydraulic connection with the inlet/outlet header 12 and return header 14. A partition 18 is provided in each of the headers 12, 14, thereby dividing each header into a first chamber 20 and a second chamber 22. The first chambers 20 of the respective headers 12, 14 together with the associated group of refrigerant tubes 16 extending therebetween define an upper condenser portion 24. Similarly, the second chambers 22 of the respective headers 12, 14 together with the associated group of refrigerant tubes 16 extending therebetween define a lower sub-cooler portion 26. Extending adjacently parallel to the return header 14 is a receiver tank 28 for retaining and supplying the required amounts of refrigerant to the overall air conditioning system as demanded by the cooling load. The upper condenser portion 24 cooperates with the receiver tank 28 to provide a liquefied refrigerant at or just below its saturation temperature to the sub-cooler portion 26, in which the liquefied refrigerant is further cooled to a predetermined temperature below the saturation temperature of the refrigerant. It is known that further cooling, also known as sub-cooling, of the liquefied refrigerant prior to an expansion valve (not shown) increases the cooling performance of the air conditioning system.

A first fluid port 30 is provided between the first chamber 20 of the return header 14 and the receiver tank 28 for directing a condensed refrigerant from the condenser portion 24 to the receiver tank 28. The condensed refrigerant entering the receiver tank 28 is near its saturation temperature and therefore, may contain a mixture of vapor and liquid components. A second fluid port 32 is provided between the lower portion of the receiver tank 28 and the second chamber 22 of the return header 14 for directing the liquefied refrigerant from receiver tank 28 to the sub-cooler portion 26.

The air-conditioning system is charged with a sufficient amount of refrigerant such that the surface level "S" of the liquefied refrigerant in the receiver tank 28 is above that of the second fluid port 32 to ensure that a steady supply of liquefied refrigerant is provided to the sub-cooler portion 26. It was found that as the condensed refrigerant enters the receiver tank 28 via the first fluid port 30 from the condenser portion 24, the condensed refrigerant free falls from the first fluid port 30 and impacts on the surface level S of the liquefied refrigerant contained in the receiver tank 28. The impact of the free falling condensed refrigerant onto the surface level S of the liquefied refrigerant produces a two phase refrigerant mixture having a liquid component "L" and a vapor component "V". The vapor component "V" is carried into to the sub-cooler portion 26, thereby reducing the effectiveness of the sub-cooler portion 26, and resulting in reduced efficiency of the overall air conditioning system.

Figure 2A:
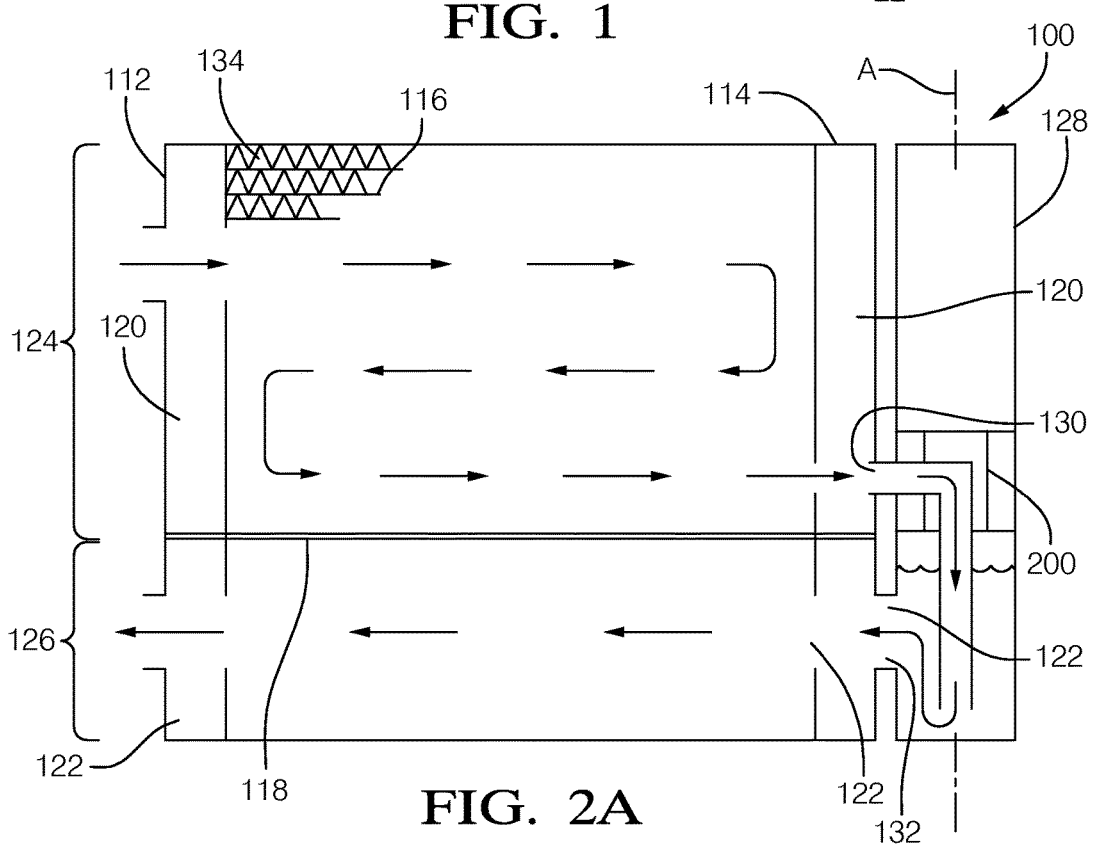
FIG. 2A shows a schematic front view of a sub-cooled condenser of the current invention having a down-flow condenser portion.
Figure 2B:
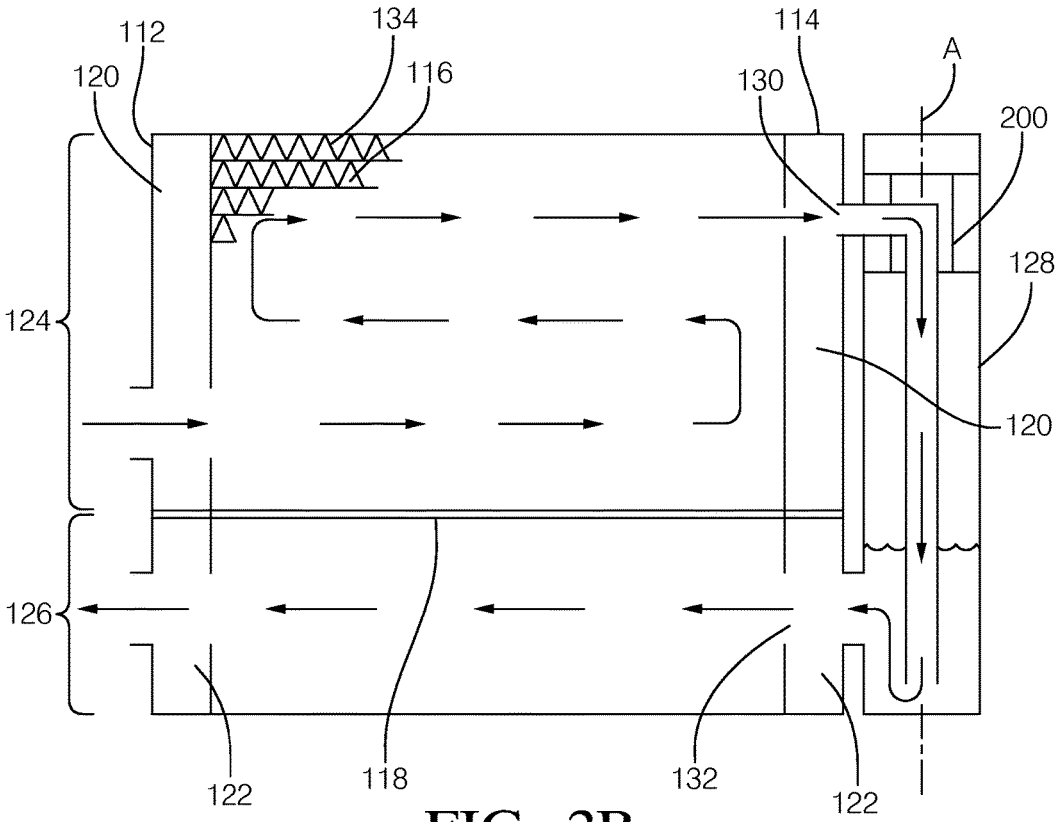
FIG. 2B shows a schematic front view of a sub-cooled condenser of the current invention having an up-flow condenser portion.

Shown in FIG. 2A is an embodiment of the sub-cooled condenser 100 of the present invention having a receiver tank 128 with an internal refrigerant diverter assembly 200. The sub-cooled condenser 100 includes a first header 112 such as an inlet/outlet header 112, a second header 114 such as a return header 114 spaced from the inlet/outlet header 112, a plurality of refrigerant tubes 116 extending between and in hydraulic communication with the inlet/outlet header 112 and return header 114. Both the inlet/outlet header 112 and return header 114 include a header partition 118 that divides each of the headers 112, 114 into corresponding first chambers and second chambers 120, 122. The associated plurality of refrigerant tubes 116 with the corresponding first chambers 120 of the inlet/out header and return header defines a condenser portion 124. Similarly, the associated plurality of refrigerant tubes 116 with the corresponding second chambers 122 of the inlet/out header and return header defines a sub-cooler portion 126. With respect to the direction of gravity, the condenser portion 124 is located above that of the sub-cooler portion 126. The condenser portion 124 may include internal partitions known in the art to configure the condenser portion 124 into a multi-pass down-flow condenser as shown in FIG. 2A or a multi-pass up-flow condenser as shown in FIG. 2B. A plurality of corrugated fins 134 may be interposed between the refrigerant tubes 116 to increase heat transfer efficiency. The condenser portion 124 and sub-cooler portion 126, together with the corrugated fins 134, define the condenser core.

Shown in FIG. 2A, adjacently parallel to and integral with the return header 114 is a receiver tank 128 extending along a receiver tank axis A. A first fluid port 130 is provided between the return header first chamber 120 and the receiver tank 128 for directing a condensed refrigerant from the condenser portion 124 to the receiver tank 128. A second fluid port 132 is provided between the return header second chamber 122 and a lower portion of the receiver tank 128 for directing a liquefied refrigerant from the lower portion of the receiver tank 128 to the sub-cooler portion 126. Inserted into the receiver tank 128 is a refrigerant diverter assembly 200 that diverts and channels the condensed refrigerant from the first fluid port 130 to a location at or beneath that of the second fluid port 132 within the receiver tank 128. Shown in FIG. 2B is another embodiment of the present invention, in which a multi-pass up-flow condenser is shown with the first fluid port 130 in hydraulic communication with the upper portion of the receiver tank 128. The location of first fluid port 130 is required to be up higher in the receiver tank 128 for an up-flow condenser than that of a down-flow condenser. Another embodiment may be that of a cross-flow condenser (not shown) in which the location of the first fluid port 130 may be located anywhere between first chamber 120 of the return header 114 and the receiver tank 128.

Figure 3:
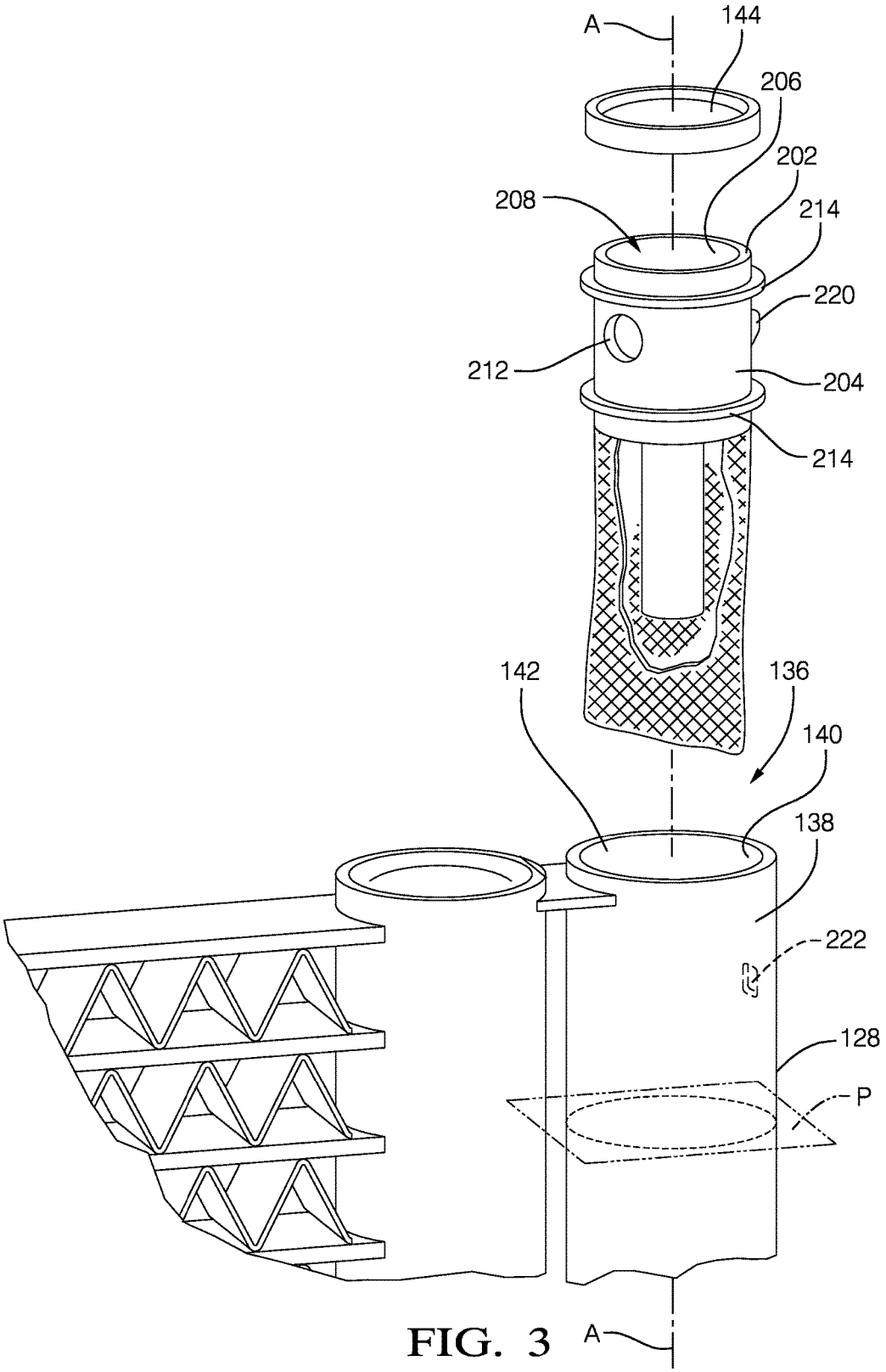
FIG. 3 shows a partial perspective view of an embodiment of the current invention with a refrigerant diverter assembly being inserted into an open end of a receiver tank.
Figure 4:
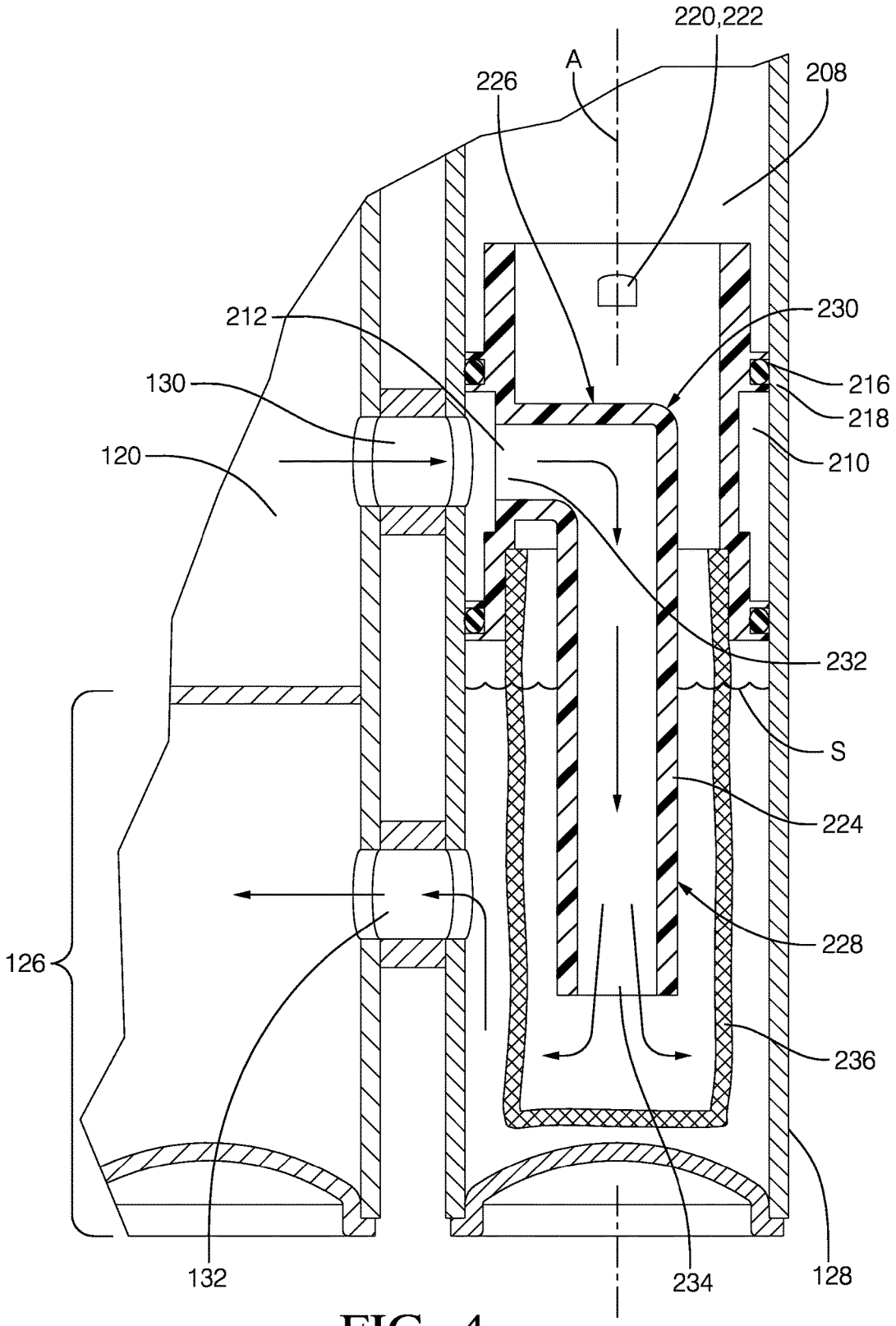
FIG. 4 shows a partial cross sectional view of the refrigerant diverter assembly of FIG. 3 inserted within the receiver tank.

Shown in FIG. 3 is partial perspective view of the refrigerant diverter assembly 200 as it is being inserted through an open end 136 of the receiver tank 128. The receiver tank 128 includes a receiver housing 138 having a receiver housing interior surface 140 that defines a receiver cavity 142. As a non-limiting example, the receiver housing interior surface 140 defines a cross-sectional shape of a circle on a plane P that is perpendicular to the receiver tank axis A. The refrigerant diverter assembly 200 shown includes a cylindrical perimeter diverter wall 202 having an exterior wall surface 204 that defines a cross-sectional shape complementary to that of the cross-sectional shape defined by the receiver housing interior surface 140. The cross-sectional area of the diverter assembly 200 is smaller than that of the cross-sectional area of the receiver tank 128 such that the refrigerant diverter assembly 200 may be inserted axially into the receiver tank 128 through the receiver tank open end 136, which is then sealed with an end cap 144. When inserted into the receiver cavity 142, the exterior wall surface 204 of the perimeter diverter wall 202 is oriented toward the receiver housing interior surface 140, thereby defining an annular refrigerant passageway 210 therebetween, which is best shown in FIG. 4. The perimeter diverter wall 202 also includes an interior wall surface 206 opposite that of the exterior wall surface 204. The interior wall surface 206 defines an axial refrigerant passageway 208 through the refrigerant diverter assembly 200. The axial refrigerant passageway 208 allows the surface level (S) of the liquefied refrigerant to fluctuate above and below the diverter assembly 200 to account for the varying demand on the amount of refrigerant required based on the loading of the air conditioning system.

The perimeter diverter wall 202 defines a refrigerant port 212 that provides hydraulic communication between the exterior and interior wall surfaces 204, 206. The exterior wall surface 204 includes annular sealing means 214 that spaces the exterior wall surface 204 from the receiver housing interior surface 140 to define the width and height of the annular refrigerant passageway 210 therebetween. A annular sealing mean may include an O-ring groove 216 defined on the exterior wall surface 204 and an O-ring 218 placed into the O-ring groove 216. The exterior wall surface 204 may be provided with two annular sealing means 214, one above the refrigerant port 212 and one below the refrigerant port 212. The annular sealing means 214 may position and secure the refrigerant diverter assembly 200 in a predetermined position within the receiver housing 138. The exterior surface 204 of the perimeter diverter wall 202 may define a protrusion 220 that corresponds to an indentation 222 on the receiver housing interior surface 140, or vice versa, to locate and retain the diverter assembly 200 in a predetermine location within the receiver housing 138.

Best shown if FIG. 4, the refrigerant diverter assembly 200 includes a refrigerant conduit 224 having a first portion 226 extending in a radial direction with respect to the receiver tank axis A and a second portion 228 extending in the axial direction. The refrigerant conduit 224 includes an elbow 230 that transitions the first portion 226 into the second portion 228. The first portion 226 includes an inlet end 232 that is in direct hydraulic connection with the annular refrigerant passageway 210 by way of the refrigerant port 212 and the second portion 228 includes an outlet end 234 spaced from the inlet end 232. The outlet end 234 of the refrigerant conduit 224 extends to or below the second fluid port 132 once the refrigerant diverter assembly 200 is positioned within the receiver tank 128. A filter assembly 236 may be attached to the refrigerant diverter assembly 200 surrounding the outlet end 234 of the refrigerant conduit 224. A desiccant material (not shown) may be positioned in the receiver cavity 142 above or below the refrigerant diverter assembly 200.

The air-conditioning system is charged with sufficient refrigerant such that a sufficient amount of refrigerant is retained with the receiver cavity 142 in which the surface level "S" of the liquefied refrigerant is above that of the second fluid port 132 to ensure that a steady supply of liquefied refrigerant is provided to the sub-cooler portion 126. Referring to FIGS. 2A and 2B, a high pressure vapor refrigerant enters the inlet/out header first chamber 120 and flows through the condenser portion 124 to the return tank first chamber 120. The refrigerant may change directions in the return tank and back to the inlet/outlet tank first chamber 120 in multiple passes for a multi-pass condenser. As the refrigerant flows across through the condenser portion 124, heat is released to the ambient air and the high pressure vapor refrigerant is condensed to a high pressure substantially liquid refrigerant near its saturation temperature.

The condensed refrigerant flows from the return header first chamber 120 through the first fluid port 130 into the annular refrigerant passageway 210. The annular refrigerant passageway 210 provides the advantage of guiding the condensed refrigerant into the inlet end 232 of the refrigerant conduit 224 without the need to align the refrigerant port 212 of the refrigerant diverter assembly 200 directly with the first fluid port 130 of the return tank. The annular refrigerant passageway 210 guides the condensed refrigerant to the refrigerant port 212 and down through the refrigerant conduit 224 into the receiver tank 128 at or below the second fluid port 132.

The submerged outlet end 234 of the refrigerant conduit 224 enables the liquefied refrigerant to enter the receiver tank 128 below the refrigerant surface level S. Without the refrigerant conduit 224 having the outlet end 234 below the refrigerant surface level S and adjacent to or below the second fluid port 132, the liquefied refrigerant entering the top of the receiver cavity 142 would impact the refrigerant surface S, thereby causing turbulent mixing of the liquefied refrigerant with the vapor refrigerant present in the receiver tank, and thus disrupting the supply of liquefied refrigerant to the sub-cooler portion 126.

The refrigerant diverter assembly 200 may be placed anywhere within the receiver housing 138 above the second fluid port 132 to account for the location of the first fluid port 130, which may be dictated by the upward, downward, or cross flow pattern of the condenser portion 124. The length of the refrigerant conduit 224 may be adjusted to ensure that the outlet end 234 is at or below that of the second fluid port 132. It is preferable that the outlet end 234 of the refrigerant conduit 224 is placed at least the distance of ½ the inner diameter (I.D.) of the refrigerant conduit 224 below the second fluid port 132. For example, if the I.D. of the refrigerant conduit 224 is 8 mm, then the outlet end 234 of the refrigerant conduit 224 should at least extend 4 mm pass the second fluid port 132. This will ensure that the liquid phase refrigerant L will discharge from the refrigerant conduit 224 beneath the refrigerant surface level S within the receiver tank 128.

The sub-cooled condenser 100, including the headers 112, 112, refrigerant tubes 116, and receiver housing 138 may be manufactured from any materials or methods known by those of ordinary skill in the art. As a non-limiting example, the sub-cooled condenser 100 may be manufactured from an aluminum alloy, assembled, and brazed. The refrigerant diverter assembly 200 may be manufactured and assembled from an aluminum alloy amendable of being brazed to the receiver tank 128, or may be molded out of any known plastic material and held in place within the receiver tank 128 by detents and sealing means.

An advantage of an embodiment of the sub-cooled condenser 100 having refrigerant diverter assembly 200 ensures a stable liquefied refrigerant to the sub-cooler portion 126 of the sub-cooled condenser 100 regardless if the condenser portion 124 is an up-flow condenser, down-flow condenser, or cross-flow condenser. Another advantage is that the sub-cooled condenser 100 absorbs the fluctuations in the required refrigerant amount inside the refrigerant cycle caused through changes in load demands. Yet another advantage is that the sub-cooled condenser 100 maintains constant performance and quality against leakage of refrigerant from hoses and fittings. Still yet another advantage is that the sub-cooled condenser 100 is compact and simple to plumb within a motor vehicle.

While this invention has been described in terms of the preferred embodiments thereof, it is not intended to be so limited, but rather only to the extent set forth in the claims that follow.

Having described the invention, it is claimed:

1. A sub-cooled condenser for use in an air conditioning system, comprising:

a first header having a header partition dividing the first header into a first chamber and a second chamber;

a second header having a header partition dividing the second header into a first chamber and a second chamber;

an upstream group of refrigerant tubes extending between and in hydraulic connection with the first chamber of the first header and the first chamber of the second header, thereby defining a condenser portion;

a downstream group of refrigerant tubes extending between and in hydraulic connection with the second chamber of the first header and the second chamber of the second header, thereby defining a sub-cooler portion;

the condenser portion is located above the sub-cooler portion with respect to the direction of gravity;

a receiver tank having an interior surface with a first fluid port in hydraulic connection with the condenser portion for receiving a refrigerant from the condenser portion and a second fluid port in hydraulic connection with the sub-cooler portion for discharging the refrigerant to the sub-cooler portion, wherein the receiver tank is configured to retain a liquid phase refrigerant having a surface level (S) below the first fluid port and above the second fluid port; and a refrigerant diverter assembly disposed in the receiver tank, wherein the refrigerant diverter assembly is configured to divert the liquid phase refrigerant from the first fluid port of the receiver tank to a location within the receiver tank where the liquid phase refrigerant is discharged beneath the surface level (S) of the liquid phase refrigerant without impacting onto the surface level (S), wherein the refrigerant diverter assembly has a perimeter diverter wall with an exterior surface opposite interior surface and surrounded by the interior surface of the receiver tank, a refrigerant port extending through the perimeter diverter wall and in hydraulic communication with the exterior and interior surfaces, a first annular sealing means disposed on a first side of the refrigerant port on the exterior surface in sealing contact with the interior wall of the receiver tank, and a second annular sealing means disposed on a second side of the refrigerant port on the exterior surface in sealing contact with the interior wall of the receiver tank, the second side being opposite of the first side relative to the refrigerant port, wherein the refrigerant diverter assembly is positioned in the receiver cavity such that the exterior surface of the perimeter diverter wall is oriented toward and spaced from the interior surface of the receiver tank, thereby defining an annular refrigerant passageway between the exterior surface of the perimeter diverter wall, the interior surface of the receiver tank, and the first and second annular sealing means.

2. The sub-cooled condenser of claim 1, wherein the first fluid port is in hydraulic communication with the refrigerant port.

3. The sub-cooled condenser of claim 2, wherein the receiver tank comprises an elongated receiver housing adjacent to the second header, an open end, an end cap sealing the open end, wherein the interior surface of the receiver tank is formed by the elongated receiver housing and defines a receiver cavity;

wherein the refrigerant diverter assembly is configured to be insertable into the receiver cavity through the open end of the receiver housing with the first and second annular sealing means abutting the interior surface of the receiver housing.

4. The sub-cooled condenser of claim 1, wherein the refrigerant port of the refrigerant diverter assembly is in hydraulic communication with the first fluid port, such that the refrigerant flows from condenser portion through the first fluid port of the receiver tank into the annular refrigerant passageway and then exits through the refrigerant port of the refrigerant diverter assembly.

5. The sub-cooled condenser of claim 4, wherein the interior surface of the perimeter diverter wall defines an axial refrigerant passageway through the refrigerant diverter assembly.

6. The sub-cooled condenser of claim 5, wherein the refrigerant diverter assembly further comprises a refrigerant conduit having an inlet end in direct hydraulic communication with the annular refrigerant passageway through the refrigerant port.

7. The sub-cooled condenser of claim 6, wherein the refrigerant conduit includes an outlet end immediately adjacent to or beneath the second fluid port with respect to the direction of gravity.

8. The sub-cooled condenser of claim 7, wherein the refrigerant conduit includes a radially extending portion having the inlet end, an axially extending portion having the outlet end, and an elbow transitioning the radially extending portion to the axially extending portion.

9. The sub-cooled condenser of claim 8, wherein the refrigerant conduit is partially disposed in the axial refrigerant passageway of the refrigerant diverter assembly.

10. The sub-cooled condenser of claim 9, wherein one of the exterior surface of the perimeter diverter wall and the interior surface of the receiver tank defines a protrusion and the other defines an indentation having a shape complementary of that of the protrusion to locate and maintain the refrigerant diverter assembly within a predetermined location with the receiver tank.

11. The sub-cooled condenser of claim 9, wherein the axially extending portion of the refrigerant conduit includes an inner diameter, and the outlet end of the refrigerant conduit extends a distance of at least ½ of the inner diameter of the refrigerant conduit below the second fluid port.

12. The sub-cooled condenser of claim 9, wherein the refrigerant diverter assembly includes a filter assembly.

13. The sub-cooled condenser of claim 12, wherein the filter assembly includes a desiccant material.

14. A sub-cooled condenser for use in an air conditioning system, comprising:

a condenser portion;

a sub-cooler portion immediately adjacent to and below the condenser portion with respect to the direction of gravity;

a receiver tank having a first fluid port in a wall of the receiver tank in hydraulic connection with the condenser portion for receiving a refrigerant from the condenser portion and a second fluid port in the wall of the receiver tank in hydraulic connection with the sub-cooler portion for discharging the refrigerant to the sub-cooler portion, wherein the receiver tank is configured to retain a liquid phase refrigerant having a surface level (S) below the first fluid port and at or above the second fluid port; and a refrigerant diverter assembly disposed in the receiver tank, wherein the refrigerant diverter assembly includes a refrigerant conduit having an inlet end above the surface fluid level in hydraulic communication with the first fluid port, and an outlet end inside the receiver tank and surrounded by the liquid phase refrigerant, the outlet end extending to or below the second fluid port such that all of the liquid phase refrigerant entering the receiver tank from the condenser portion passes through the refrigerant conduit and is discharged from the outlet end beneath the surface level (S) of the liquid phase refrigerant without impacting onto the surface level (S), wherein the refrigerant diverter assembly further includes a perimeter diverter wall having an exterior surface, a refrigerant port providing hydraulic communication with the inlet end of the refrigerant conduit, and a first annular sealing means disposed on a first side of the refrigerant port on the exterior surface and a second annular sealing means disposed on a second side of the refrigerant port on the exterior surface, the second side being opposite the first side.

15. The sub-cooled condenser of claim 14, wherein the outlet end of the refrigerant conduit includes an inner diameter, and the outlet end of the refrigerant conduit extends a distance of at least ½ of the inner diameter of the refrigerant conduit below the second fluid port.

16. The sub-cooled condenser of claim 14, wherein the refrigerant diverter is positioned in the receiver tank such that the exterior surface of the perimeter diverter wall is oriented toward and spaced from an interior surface of the receiver housing, thereby defining an annular refrigerant passageway between the surfaces and the first and second annular sealing means.

* * * * *